United States Patent [19]

Faulconer et al.

[11] Patent Number: 4,690,314

[45] Date of Patent: Sep. 1, 1987

[54] BUOYANCY COMPENSATOR INSERTABLE BACKPACK

[76] Inventors: Mark Faulconer, 1555 Mesa Verde East, Costa Mesa, Calif. 40100; Scott E. Greatrake, 101 La Hacienda, Fountain Valley, Calif. 40202

[21] Appl. No.: 769,125

[22] Filed: Aug. 26, 1985

[51] Int. Cl.[4] ..... A45F 3/08

[52] U.S. Cl. ..... 224/211; 224/153; 441/90

[58] Field of Search ..... 224/214, 211, 153, 262, 224/210, 261; 441/90, 92, 96

[56] References Cited

U.S. PATENT DOCUMENTS

| | | | |
|---|---|---|---|
| 3,033,431 | 5/1962 | Henderson et al. | 224/211 |
| 3,065,888 | 11/1962 | Lande | 224/211 |
| 3,891,131 | 6/1975 | Tabata | 224/211 |
| 3,957,183 | 5/1976 | Gadberry | 224/211 |
| 3,964,266 | 6/1976 | Bartlett | 441/96 X |
| 4,054,132 | 10/1977 | Deede | 441/96 X |
| 4,310,110 | 1/1982 | Dexter | 224/211 |
| 4,379,656 | 4/1983 | Darling | 441/96 X |
| 4,449,655 | 5/1984 | Germe | 224/153 |

*Primary Examiner*—Stephen Marcus
*Assistant Examiner*—David Voorhees

[57] ABSTRACT

A buoyancy compensator insertable backpack is disclosed herein in the form of a configured insert having an inverted T conformation. The inverted T conformation has an upright portion with ribs thereon which provide rigidity to the upright and includes at least one set of slits therethrough in order to secure a breathing gas tank by a metal band passing therethrough and around the tank. The lower or transverse portion of the inverted T shaped backpack is curved to follow the contour of a person's torso so that support can be provided to the upright portion by having a load distributed across a person's torso in the pelvis, small area of the back, or hip area. The entire insertable backpack is implaced with a buoyancy compensator so as to provide for support of a breathing gas tank on the backpack within the buoyancy compensator, all of which are secured on a user's body for providing buoyancy compensation and attendant support of a breathing gas tank.

22 Claims, 9 Drawing Figures

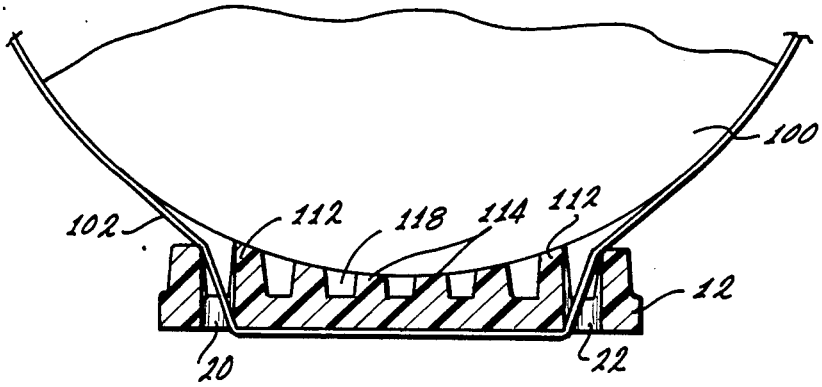
Fig. 6
Fig. 7
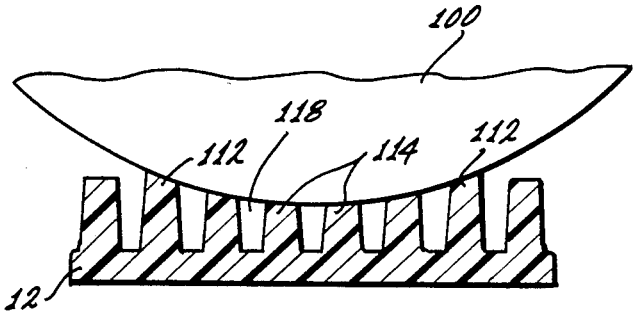
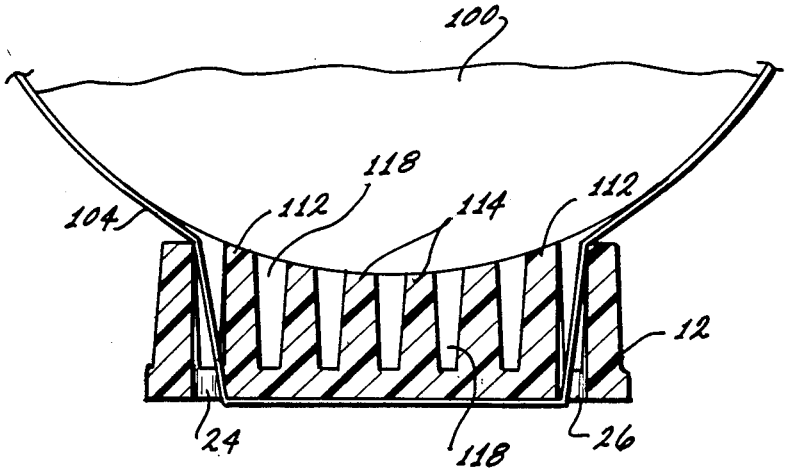
Fig. 8

BUOYANCY COMPENSATOR INSERTABLE BACKPACK

FIELD OF THE INVENTION

The field of this invention lies within the diving art. More particularly, it belongs within the art of diving within the sport and commercial diving area wherein self-contained underwater breathing apparatus is utilized. It particularly pertains to self-contained underwater breathing apparatus including a buoyancy compensator which compensates for various depths at which a diver is, in order to maintain proper buoyancy at that depth in the form of a vest that provides the buoyancy compensation.

THE PRIOR ART

The prior art with regard to backpacks and buoyancy compensators included myriad means of support for breathing gas tanks. One of the means of support for breathing gas tanks was a backpack having harnesses and straps extending therefrom.

In particular, a backpack was disclosed in U.S. Pat. No. 3,957,183 to Gadberry. In this particular patent, it can be seen that a backpack is formed with a handle at the upper end of a curved plastic material. The curved plastic material supports a breathing gas tank.

The foregoing prior art backpacks incorporated shoulder harnesses and a waist strap or waist band which is secured around a person's waist. The load is implaced on a person's shoulders by reason of the fact that the backpack pulls downwardly on the shoulder through the harnesses. The backpack is such wherein it supports a breathing gas tank which is generally the heaviest piece of equipment that a diver uses. The breathing gas tank not only incorporates the tank itself, but also the first stage regulator attached thereto and other support mechanisms.

As can be understood, the full loading of the backpack is across a user's shoulders. The tanks are usually supported away from a user's back and are oriented so as to gravitationally pull down on the backpack and the attendant shoulder harnesses over a user's shoulders. Such a design causes a user to become tired during the carrying of the backpack with the breathing gas tank thereon. In order to soften the load on a user's shoulders, some backpacks have been incorporated with buoyancy compensators to spread the load through the buoyancy compensator material across a user's back.

More particularly, it can be seen in the prior art that buoyancy compensators are provided with backpacks which extend from the inside of the buoyancy compensator toward the outside of the buoyancy compensator, which in turn receives the breathing gas tank thereon. The breathing gas tank is secured to the backpack by means of bands or straps which pass through the buoyancy compensator and surround the breathing gas tank and strap it thereto.

Regardless of the foregoing designs, whether they be backpacks in attendant relationship with a buoyancy compensator or backpacks supported independently with their own straps, the loading generally takes place across a user's shoulders. Thus, the entire loading is not cantilevered and supported in any manner so as to spread it across a user's body, but concentrates it generally in the shoulder area. This invention overcomes the deficiencies of the prior art by first of all providing a more comfortable loading and secondly providing a backpack which is lightweight and easily inserted within a buoyancy compensator.

In particular, the breathing gas tank backpack of this invention incorporates an inverted T configuration. The upright portion of the inverted T has at least one band or strap, or attachment means, connected thereto for securing a breathing gas tank thereon. This strap or securement means holds the breathing gas tank in tightened adjacent relationship to the upright portion of the inverted T.

The cross members of the inverted T extend from the T upright and are configured to conform around a user's waist. In this manner, they extend around a user's waist and provide a comfortable positioning of the backpack against a user's waist or pelvis.

The upright portion of the inverted T and the cross members are easily inserted into the fabric or material of the buoyancy compensator and provide for ready and facile implacement therein. Upon implacement, the backpack can be used as any normal backpack but tends to distribute the load in a more comfortable manner.

As to the load distribution, it can be understood that when a breathing gas tank is on the upright inverted portion of the T, it pulls downwardly on the upright portion of the inverted T and thereby causes a loading on the cross members. These cross members in turn are imposed against a user's pelvis or waist and thereby the load is distributed against a user's body in a measurable manner to relieve the weight across a user's shoulders.

SUMMARY OF THE INVENTION

In summation, this invention comprises a buoyancy compensator backpack in the form of an inverted T that receives the loading of a breathing gas tank thereon and spreads it through the cross member of the T across a user's pelvis or waist.

More specifically, the invention comprises a backpack formed as an inverted T. The inverted T has an upright portion and a cross member portion. The upright portion has a plurality of ribs thereon for stiffening so that it can receive the load of a breathing gas tank connected thereto in a manner whereby it will not axially bend significantly under the loading. In addition thereto, the upright portion has slits therein which receive a band therethrough which passes around a breathing gas tank for securement thereof. This band can be a metal band in the form of prior art bands that are known in the art with an overcenter snap catch for securing the band around the tank in frictional engagement therewith and in connected relationship to the upright of the inverted T.

The inverted T has a cross member which curves around a user's waist and serves to receive a load on the upright portion and distribute it on a user's pelvis or waist. The cross member has slots therein for receiving a looped webbed belt for passing therethrough and securing the backpack around a user's waist.

The entire assembly of the webbed belt and backpack is inserted within a buoyancy compensator and held therein for securing the backpack to the rear portion of the buoyancy compensator. The buoyancy compensator is secured around a user's body by means of a buckle or securement of any other particular type. The buoyancy compensator can have side webbing adjustment means for bringing the buoyancy compensator into a snug fit with a user's body.

BRIEF DESCRIPTION OF THE DRAWINGS

FIG. 6 shows a sectioned view of the backpack shown in FIG. 3 as sectioned along lines 6—6 thereof and incorporating the breathing gas tank attached thereto.

FIG. 7 shows a sectioned view of the backpack along lines 7—7 of FIG. 3 with the breathing gas tank lying against the backpack.

FIG. 8 shows a sectioned view along lines 8—8 of FIG. 3 showing the backpack with a band clamping means holding a breathing gas tank against the backpack.

DESCRIPTION OF THE PREFERRED EMBODIMENTS

Figure 1:
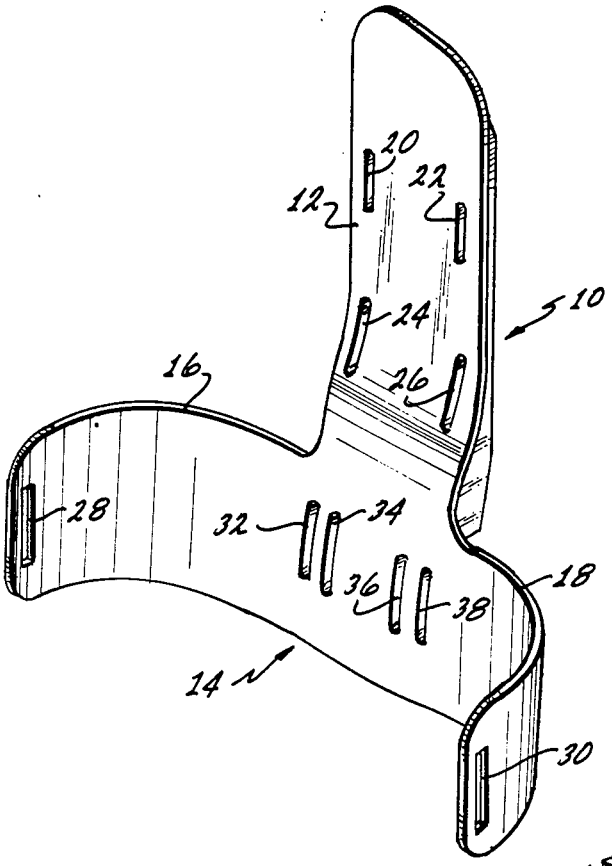
FIG. 1 shows a perspective view of the buoyancy compensator insertable backpack.

Looking at FIG. 1, it can be seen that the backpack of this invention is an insertable backpack for a buoyancy compensator. The backpack is shown as a backpack 10 in the form of an inverted T. The inverted T has an upright portion 12 and a lateral or cross portion 14 which extends in tow cross members 16 and 18. The cross members 16 and 18 have a curved configuration which can conform to a user's waist on pelvis area.

The upright 12 and the cross members 16 and 18 are made of a relatively flexible plastic or other material which can flex, including such materials as steel or stiffened elastomers having ribs therein for bracing. Suffice it to say, in this particular configuration, the cross members 16 and 18 are flexible and can be moved about a user's pelvis or waist to more comfortably fit the user and support the breathing gas tank in the manner to be described hereinafter.

The upright of the inverted T has two top slots 20 and 22. These two top slots or slits receive a band which can circumscribe a breathing gas tank. In addition thereto, two lower slots 24 and 26 are provided which receive a second band therethrough. The bands received through the first slots 20 and 22 and the second slots 24 and 26 circumscribe a breathing gas tank to hold it in tightened juxtaposition to the upright 12 of the backpack. The band can be in the form of a stainless steel band having an overcenter latch or tightening means for securing the band around the breathing gas tank in the same manner of the latches shown in U.S. Pat. No. 3,957,183 to Gadberry.

The lateral or cross member 14 has two outside slots 28 and 30. The outside slots 28 and 30 receives a webbed belt 40 or other securement around a user's waist that can also serve to pass through a plurality slots 32 and 34 and 36 and 38. This plurality of slots 32 through 38 receive the webbed belt 40 or other suitable support means for holding the backpack in juxtaposition to a user's waist.

Figure 2:
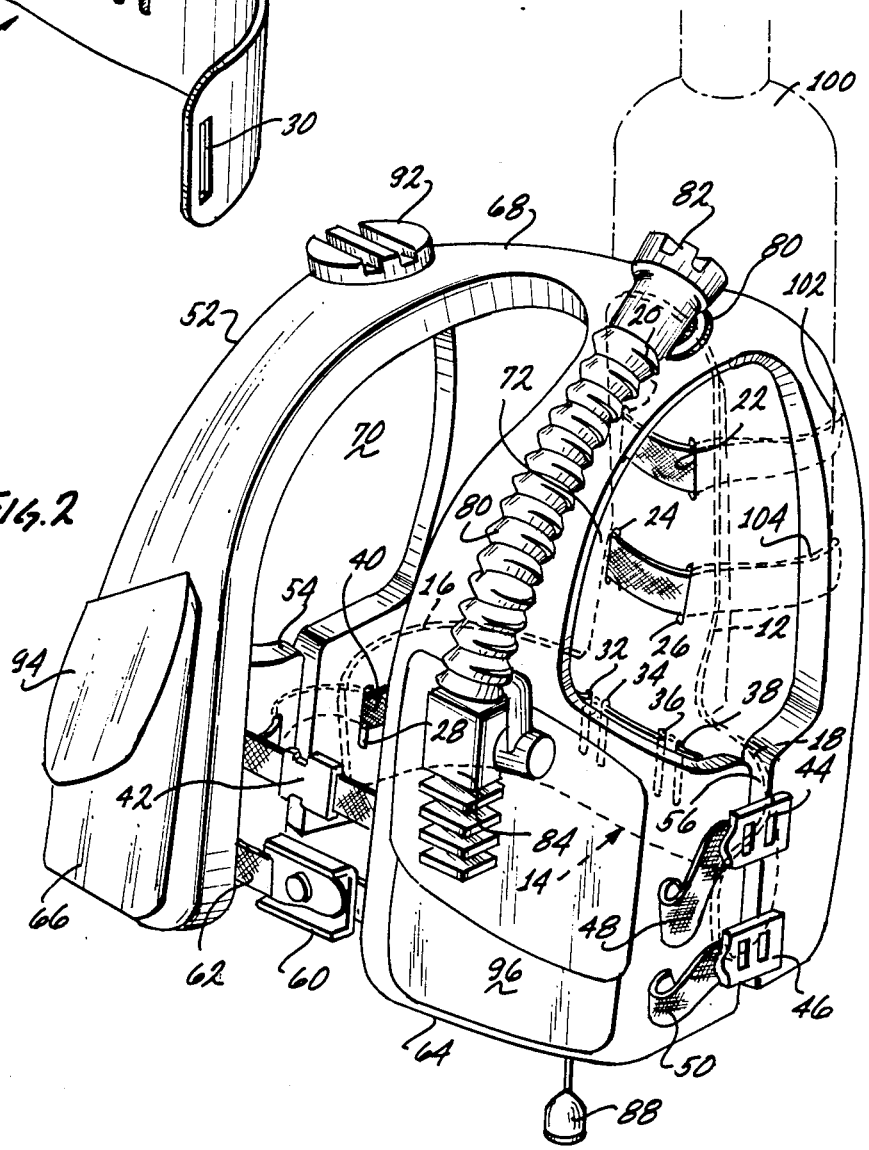
FIG. 2 shows a buoyancy compensator with the backpack implaced therein and a dotted configuration of a breathing gas tank attached to the backpack.
Figure 3:
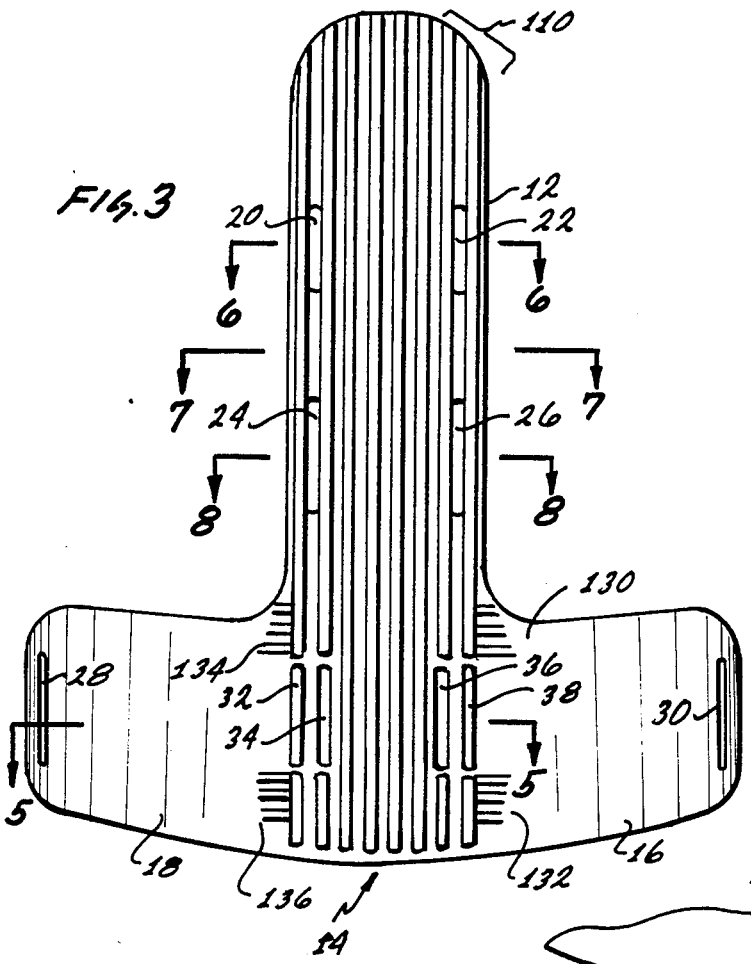
FIG. 3 shows a rear elevation view looking from the rear of the showing of FIG. 1.
Figure 4:
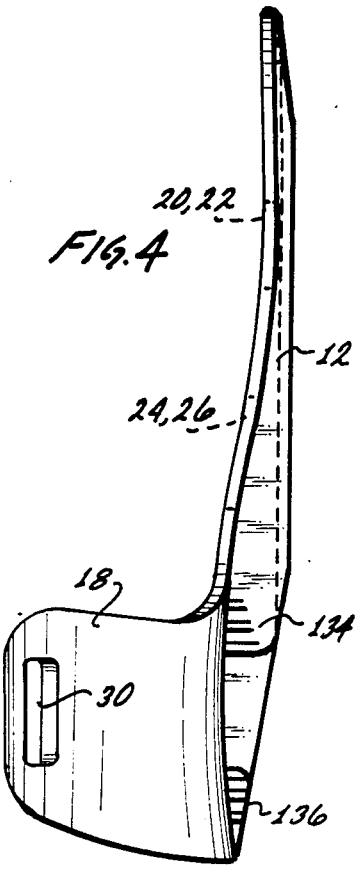
FIG. 4 shows a view looking from the left side of FIG. 3 which forms a side elevation view thereof.
Figure 5:
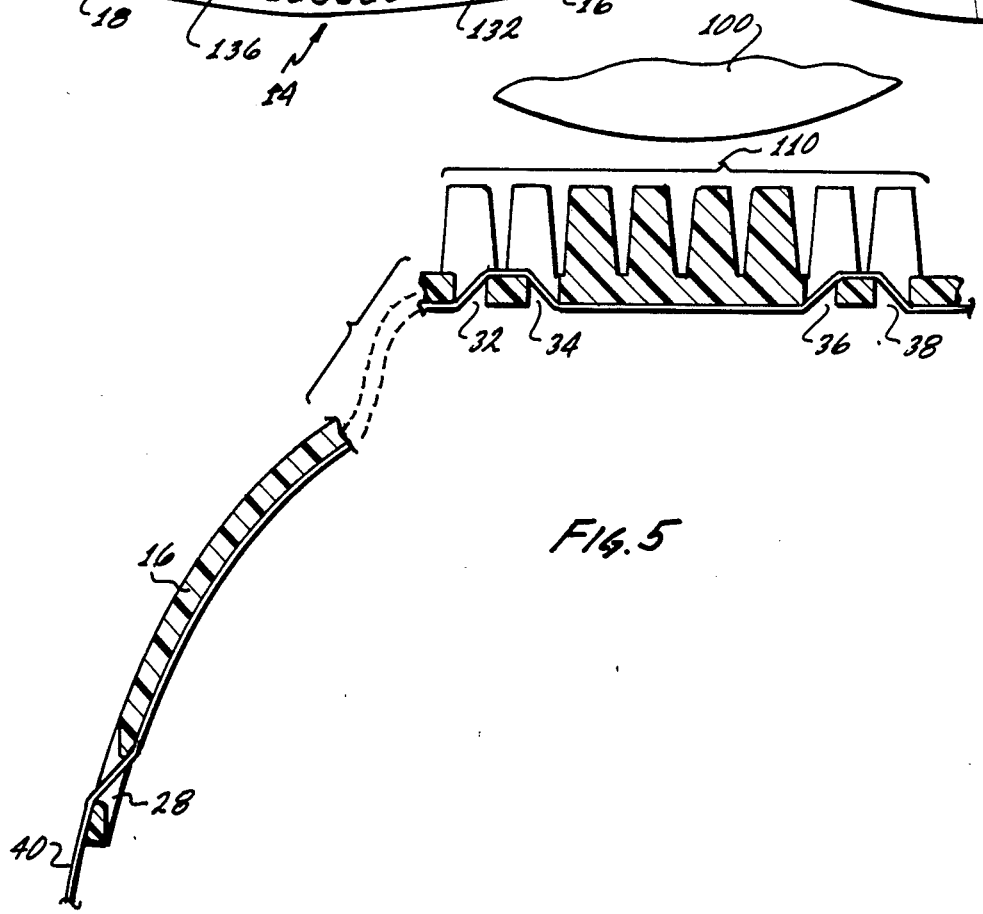
FIG. 5 shows a sectional view as sectioned along lines 5—5 of FIG. 3.

The belt 40 can pass through the slots in the manner generally shown in FIGS. 2 and 5 so that it passes from the outside through slot 28 to the inside and thence to the outside from slot 32 and back to the inside through slot 34. It then extends through slot 36 to the outside back through slot 38 and thence through slot 30 to the outside. In this manner, when the belt or web 40 as shown in FIG. 2 is utilized, it can comfortably support the backpack 12 against a user's body in the manner as will be seen hereinafter.

Figure 9:
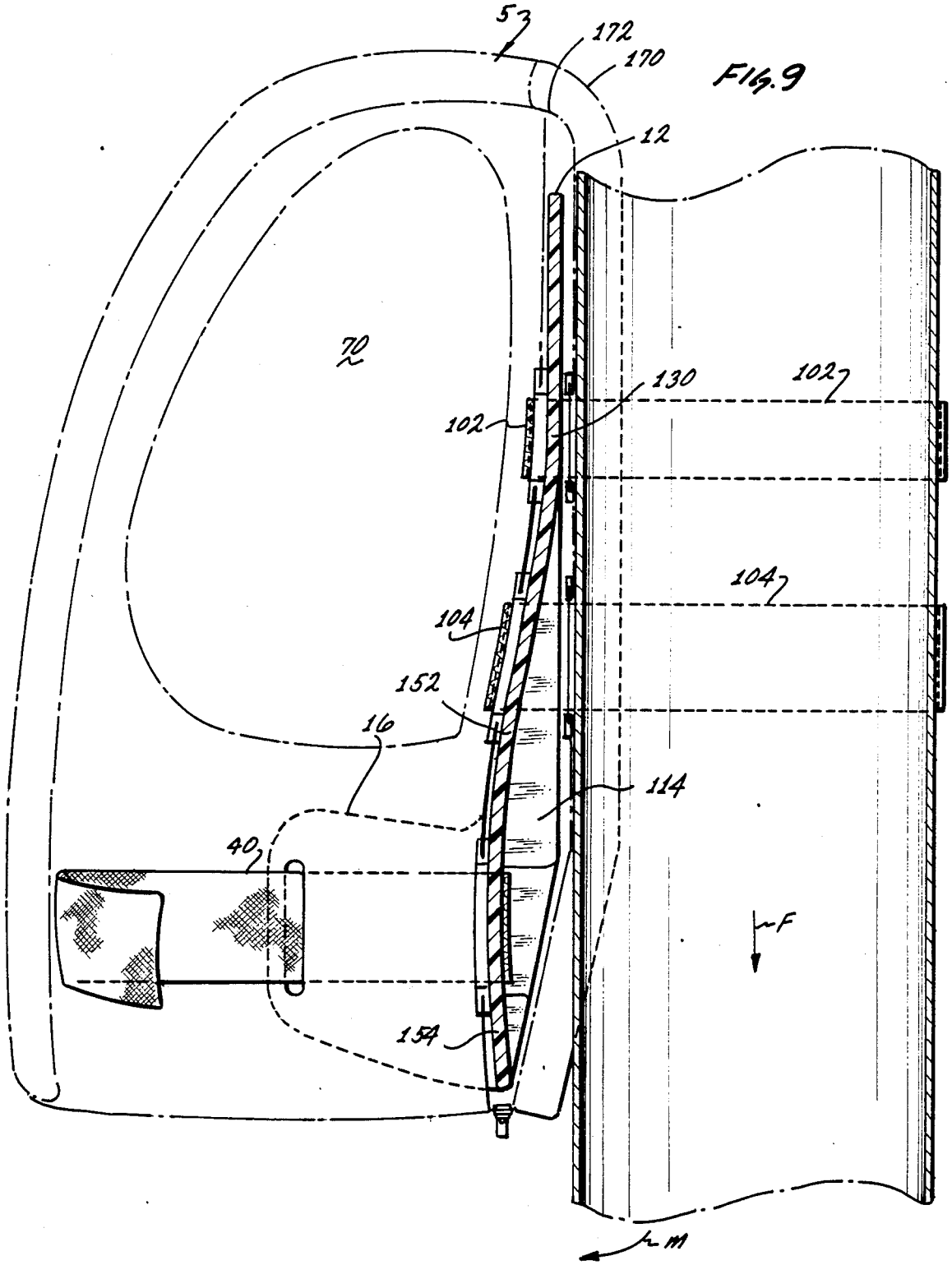
FIG. 9 shows a sectioned view taken through the midline section of the backpack and breathing gas tank with the buoyancy compensator dotted into position as seen through a midline section generally of FIG. 2.

The strap passing through the cross members or lateral portion 14 of the backpack can be seen as strap 40 in FIGS. 2, 5 and 9. Strap 40 of course can be secured by any suitable attachment means and has been shown in this particular instance as attached by a buckle 42 in the form of a Fastex type of buckle. A buckle or strap adjustment can also be utilized along the side of the buoyancy compensator in the form of buckle strap adjustment 44 and 48 connected to webs 48 and 50. This allows for adjustment of a buoyancy compensator 52 at the side edges thereof.

In this particular embodiment, a buoyancy compensator 52 is shown having a slit portion 54 and 56 interconnected by the webs 48 and 50 that are adjusted by the buckle strap adjustments 44 and 46. The buckle strap adjustments 44 and 46 can be in the form of any looped belt buckle arrangement, tanged snap arrangement, or other suitable adjustment means. They should be connected to the front and back portions of the buoyancy compensator at the split portion 54 and 56 to allow for adjustment of the buoyancy compensator around a user's waist. In order to provide for further adjustment, a buckle and strap, respectively buckle 60 and strap 62 are interconnected to the respective left side 64 and right side 66 of the buoyancy compensator 52 as is used by an individual.

The rear portion of the buoyancy compensator vest is shown as a major rear portion 68 interconnected to the left portion 64 and right portion 66 having openings 70 and 72 for a user's arms.

The buoyancy compensator has an inflator assembly 76, the inflator assembly 76 incorporates an inflator hose 80 connected to the interior portion of the buoyancy compensator bladder through a urethane washer 80. The urethane washer 80 serves as a large grommet passing through the buoyancy compensator fabric to the interior of the vest and in particular, to the bladder in order to connect the inflator hose 76 thereto. In addition thereto, a valving port 82 is shown connected to the inflator 76. The valving port 82 connected to the inflator allows for valving outwardly of the gas in the buoyancy compensator.

In order to inflate the buoyancy compensator, a combination inflator valve 84 is shown. The inflator valve can be of the type known in the prior art which utilizes a power inflator or pressurized source of gas from the first stage regulator attached to the breathing gas tank, or it can be used in a manner whereby oral blowing into a mouthpiece of the inflator 76 allows for inflation of the buoyancy compensator by a valving means through the inflator valve assembly 84.

In order to inflate the buoyancy compensator when an emergency occurs, a knob 88 is shown. The knob 88 is connected to a firing mechanism for firing a cartridge of $CO_2$ which can be utilized to fill the interior of the buoyancy compensator bladder. The firing mechanism in particular can be of the type which is known in the prior art to inflate life vests and the like and has been used for inflation of buoyancy compensators in emergency situations to allow for them to be used as a life saving device in the form of a life jacket, rather than merely for buoyancy compensation at depth.

The foregoing generally describes the configuration of the buoyancy compensator wherein a user implaces his arms into the openings 70 and 72 and secures the vest around his body by means of closing the buckles 42 and 60. The foregoing thereby allows for implacement over the user's body. For ease of utilization, a relief valve 92 is utilized for relieving overpressure in the bladder. Two pockets 94 and 96 can be provided with a flap overlying the pockets for receiving various pieces of diving equipment.

In order to show a more detailed view of the web and the strap arrangement therefor, it can be seen wherein the webbed belt 40 is shown passing through the opening 28 of the lateral member 16 which has been sectioned as shown in FIG. 5. The left belt 40 then passes through the respective openings 32 and 34 and the openings 36 and 38 to provide for the securement of the webbed belt 40 around a user's waist. The foregoing securement accounts for a tightening and overall comfortable arrangement of the backpack around a user's waist or pelvis. In particular, as the belt 40 is drawn around a user's waist, it provides for securement and tightened close fitting relationship therewith, so that it can be snugly applied to a user's waist. Thus, the loading on lateral members 16 and 18 can be placed directly in juxtaposition to a user's waist or pelvis by the snug fitting relationship and the flexibility of the lateral members 16 and 28 being flexed and drawn around a user's waist by the webbed belt 40 pulling them therearound.

The foregoing description of the transverse members 16 and 18 and the specific showing of the transverse member in FIG. 5 with the belt 40 passing through the spaces 32 through 38, describes the flexibility and enclosure capability of the transverse portions 16 and 18. However, it should be understood that a significant degree of flexibility can be provided by any type of plastic or metal or stiff elastomer used for the backpack, so long as the support of the breathing tank can take place. To this extent, for descriptive purposes, it can be seen that a breathing tank 100 has been shown in conjunction with the backpack. The tank 100 is such wherein it can have a first stage regulator connected thereto and the appropriate hoses for providing a diver with breathing gas. The significant weight of the tank 100 is applied to the upright portion 12 of the inverted T shaped member.

The upright portion 12 in order to receive and secure the tank, has two metal bands 102 and 104 therearound. The metal bands 102 and 104 circumscribe the tank 100 in a manner whereby they hold the tank 100 in tightened position against the upright portion 12 of the backpack. The band 102 as shown in FIG. 6 is bent inwardly and through slots 20 and 22 in the upright portion 12 in one configuration. In the showing of FIG. 8 the band 104 is bent inwardly into a deeper draw through slots 24 and 26, inasmuch as the backpack at that point has a substantially greater degree of thickness due to the ribs as will be described hereinafter.

The bands 102 and 104 can be clamped by any suitable means and opened and closed by an overcenter latch or other opening and closing means. The overcenter latch of course can be of the snap latch arrangement and tongue of the type shown in U.S. Pat. No. 3,957,183 to Gadberry.

The metal bands 102 and 104 can be substituted by means of webbing, plastic strapping, or any other suitable support means. To this extent, the backpack can be provided with any tank supporting means, so long as it interconnects the tank 100 to the backpack to provide sufficient support. This, in effect, can be accomplished by a depending bracket as is known in the art, or other means to support the tank on the backpack.

The upright portion of the backpack 12 has a plurality of ribs 110 shown longitudinally along the upright portion. The ribs 110 are configured so that the tops of the ribs define a curved surface against which a tank 100 can be implaced for relatively snug fitting thereof. In effect, the outer curvature of the tank 100 is accommodated against the rib's upper surfaces. This can be seen in FIGS. 6, 7 and 8, wherein the outer ribs of FIG. 6, namely ribs 112, are higher than the inner ribs 114. Again, this is shown in the other embodiments whereby ribs 112 as the relatively outer ribs are higher than ribs 114. The respective ribs provide for grooves 118 therebetween. The grooves 118 are such wherein they allow for the passage of water and drainage, as well as providing for a lightness of the entire structure.

The ribs 110 in the upper portion of the inverted T are relatively smaller in cross sectional height or thickness, as can be seen in FIG. 6. As they proceed downwardly along the longitudinal dimension of the upright portion of the T, they expand in height. This can be seen in the cross section of FIG. 8 in the lower portion. This provides for a positioning of the tank outwardly away from a person's back and at the same time allows for the lumbar support of the tank 100. The height of the ribs 110 can be seen generally with a thickened portion of greater height of the ribs 114 and 112 as shown in FIG. 9 as they proceed downwardly.

The upright portion of the T 12 with the ribs 110 in greater cross sectional height or dimension places the tank 100 outwardly away from a user's back and at the same time allows a longitudinal stiffening thereof. As can be appreciated, when the tank as shown in FIG. 9, is supported with the straps 102 and 104, it has a downward component of force F which is described by a moment shown in the direction of Arrow M so that it in effect pulls outwardly and downwardly against the straps 102 and 104. Thus, sufficient bracing must be undertaken by the ribs 110, such as ribs 114 and 112, to prevent the moment M from bending the upright portion 12 in a significant manner downwardly.

The backpack 10 with the strengthened reinforced ribs 110 is further enhanced by means of support webs or ribs that are laterally shown as webbed ribs 130 in the upper portion and 132 in the lower portion on one side and 134 and 136 on the opposing portion.

The foregoing lateral ribs 130 through 136 extend from the outer longitudinal ribs 110 to provide support and bracing to the lateral portions 16 and 18 where they extend outwardly so that at the connection point, there will be a point of strength between the lateral portions 16 and 18 and the upright 12. The bracing ribs 130 through 136 allow for a strengthening and rigidity at the point of the connection of the cross members 16 and 18 to the upright 12, so as to prevent a bending and snapping thereof of the plastic or other material at the point of connection. As can be appreciated, the lateral portions 16 and 18 flex inwardly and outwardly and it is desirable to maintain a degree of strength at the connection point thereof where the members interconnect and cross.

The backpack 10 as can be seen with regard to the upright member 12 curves inwardly at point 150 from a relatively upright position to a curved portion 152. The curved portion 152 terminates downwardly in a curved manner at a terminal portion 154 to effectively follow the contour of a user's back. This helps to provide for a loading of the tank force F downwardly to be supported in a manner whereby it is loaded against a user's back or waist in some measure, rather than across a user's shoulders. Furthermore, inasmuch as the cross members 16 and 18 are configured to be secured around a user's waist or pelvis, the loading through the moment M is fed inwardly not only at the curved portion 152 into a user's back, but also with regard to a spreading of that load across lateral members 16 and 18.

The foregoing effectively causes the load F or force downwardly to the tank 100 to be carried by a user in an area within a user's back and pelvis area rather than downwardly across the shoulder area. The prior art specifically was such wherein a loading took place across the shoulder area S of the user's shoulders which substantially increased the pulling down of a heavy tank, such as tank 100 on the user's shoulders. To avoid this, the applicants have ingeniously allowed for a loading not only on the backpack in the manner as described, but also have allowed for the backpack 10 to be inserted within the buoyancy compensator material. The outer covering of the buoyancy compensator material can be seen generally as an inner and outer material 170 and 172. This inner and outer material receives a bladder therein. The bladder is not shown in detail, but is oriented within the inner and outer material which prevents undue expansion of the bladder.

The net result is to provide for a unique loading of the tank and appurtenent apparatus such as a first stage regulator and hose or other connections to the tank to a backpack and at the same time provide for an insertable backpack within a buoyancy compensator that is separate therefrom. As a consequence, this invention is a substantial step over the prior art and should be read broadly in light of the following claims.

We claim:

1. The combination of a buoyancy compensator formed as a buoyancy compensator vest and a backpack wherein said buoyancy compensator vest has an inflator means for inflating it and maintaining it at a desired buoyancy compensation level and wherein said backpack comprises:

a T shaped inverted member formed as a unified resilient structure having an upright portion and two lateral portions extending therefrom wherein said lateral portions of said inverted T are proximate a user's lower torso area and are sufficiently flexible to flexibly curve in part around a user's waist, and said upright portion extends upwardly along a user's back:

means for connecting said backpack to said buoyancy compensator; and, means for connecting said backpack to a tank of breathing gas.

2. The combination as claimed in claim 1 wherein:

said upright portion of said backpack is curved inwardly toward a user's back along a portion thereof and when in use provides a moment toward a user's waist so that part of the load on said backpack when in use is seen at the lateral portions of said T shaped member.

3. The combination as claimed in claim 2 further comprising:

means for securing said backpack lateral portions around a user's waist.

4. The combination as claimed in claim 3 wherein:

said means for securing said lateral portions around a user's waist comprises a belt member attached to said lateral portions on either side of the upright portion of the inverted T.

5. The combination as claimed in claim 4 wherein:

said combination comprises a backpack formed with at least one reinforcing rib longitudinally along said upright portion of said T.

6. The combination as claimed in claim 5 further comprising:

said backpack formed of a bendable plastic material wherein said lateral portions can be bent around a user's torso; and, wherein said belt member is attached to said lateral portions for bendably conforming said backpack around a user's waist.

7. The combination as claimed in claim 6 further comprising:

at least one pair of openings within said lateral portions of said backpack for receiving the belt member for pulling said belt member around a user's waist.

8. The combination as claimed in claim 7 wherein:

said backpack is inserted within said buoyancy compensator outer material and maintained at least in part internally thereof; and, said means for securing said tank to said backpack comprises at least one metal band extending from said backpack for adaptation and securement around said tank and means for securing said band around said tank.

9. A buoyancy compensator having means for supporting a tank of breathing gas comprising:

a buoyancy compensator vest having openings for a user's arms:

means for retaining said buoyancy compensator vest on a user's body:

means for inflating said buoyancy compensator and controlling the amount of gas therein:

an inverted T shaped member formed as a unified resilient structure within a portion of said buoyancy compensator vest having an inverted upright portion of said T shaped member and a transverse member connected thereto having lateral unified flexible portions extending from either side that are sufficiently flexible to bend in part around a user's waist:

means for attachment of a tank of breathing gas to the upright portion of said inverted T shaped member to provide a moment when said vest is in use toward said transverse portions for load distribution on said transverse portions.

10. The buoyancy compensator as claimed in claim 9 further comprising:

means to secure said buoyancy compensator to a user's body.

11. The combination as claimed in claim 9 further comprising:

a transverse member of said inverted T shaped member having sufficient flexibility to be bent partially around a user's torso.

12. The buoyancy compensator as claimed in claim 11 further comprising:

an upright portion of said inverted T having a curved section conforming at least in part to the curve of a user's back.

13. The buoyancy compensator as claimed in claim 11 further comprising:

at least one reinforcing rib along the upright portion of said inverted T shaped member.

14. The buoyancy compensator as claimed in claim 13 wherein said means for attaching said breathing gas tank to said upright portion of said T comprises:

at least one pair of slots within said upright portion;

a metal band for insertion through said slots around a breathing gas tank; and, means for securing said band around said breathing gas tank.

15. The buoyancy compensator as claimed in claim 14 further comprising:

belt means connected to said transverse portion of said T shaped member for securing said transverse portion in bent conformation around a user's waist.

16. The buoyancy compensator as claimed in claim 15 further comprising:

a plurality of ribs along the upright portion of said inverted T defining a curved surface across the top of said ribs in a convex manner for conforming substantially to the outer curved surface of a breathing gas tank.

17. A backpack for attachment and carrying of a breathing gas tank for use by a diver wherein the improvement comprises:

a backpack member formed generally as an inverted T shaped member having an upright portion with a curved surface for conforming at least in part to a user's back and a transverse member formed of two unified lateral portions in the form of the inverted T:

lateral portions of said transverse member formed of a flexible material which can be flexed at least partially around a user's torso:

means for securing said backpack lateral portions around a user's torso:

means for attachment of said upright portion to a breathing gas tank: and, at least one reinforcing rib longitudinally extending along said upright portion.

18. The backpack as claimed in claim 17 wherein:

said means for connection to a breathing gas tank comprise at least one pair of slots in said upright portion; and, a band passing through said slots for connection around a breathing gas tank.

19. The backpack as claimed in claim 18 further comprising:

slots at either end of said transverse member of said T shaped member; and, belt means for connection to said slots for securing said transverse member in snug relationship around a user's waist.

20. The backpack as claimed in claim 19 further comprising:

a plurality of longitudinally oriented ribs extending along said upright portion of said backpack extending in a higher cross sectional dimension at the lower portion of said backpack where said transverse member crosses said upright portion; and, lateral ribs extending from said lateral portions of said transverse member to said upright portion for reinforcing said lateral portions with said upright portion.

21. The backpack as claimed in claim 20 wherein:

said plurality of ribs define a curved surface across the tops thereof in a concave manner to receive the outside curved surface of a breathing gas tank.

22. The backpack as claimed in claim 21 wherein:

said band for circumscribing a breathing gas tank comprises a metal band having an overcenter latch for securement around a breathing gas tank.

* * * * *